US007943902B2

(12) United States Patent
Ding et al.

(10) Patent No.: US 7,943,902 B2
(45) Date of Patent: May 17, 2011

(54) METHOD FOR INTRODUCING IONS INTO AN ION TRAP AND AN ION STORAGE APPARATUS

(75) Inventors: Li Ding, Sale (GB); Alan Joseph Smith, Blackley (GB); Evgenij Nikolaevich Nikolaev, Moscow (RU)

(73) Assignee: Shimadzu Research Laboratory (Europe) Limited, Manchester (GB)

( * ) Notice: Subject to any disclaimer, the term of this patent is extended or adjusted under 35 U.S.C. 154(b) by 445 days.

(21) Appl. No.: 11/916,355

(22) PCT Filed: May 26, 2006

(86) PCT No.: PCT/GB2006/001938

§ 371 (c)(1),
(2), (4) Date: Jun. 30, 2008

(87) PCT Pub. No.: WO2006/129068

PCT Pub. Date: Dec. 7, 2006

(65) Prior Publication Data

US 2009/0127453 A1 May 21, 2009

(30) Foreign Application Priority Data

Jun. 3, 2005 (GB) ..... 0511386.5

(51) Int. Cl.
*H01J 49/04* (2006.01)
*H01J 49/26* (2006.01)

(52) U.S. Cl. ..... 250/290; 250/281; 250/282; 250/283

(58) Field of Classification Search ..... 250/281, 250/282, 288, 290, 291, 292, 293, 294, 295, 250/296, 297, 285, 283
See application file for complete search history.

(56) References Cited

U.S. PATENT DOCUMENTS 2,939,952 A 6/1960 Paul et al.
4,066,894 A * 1/1978 Hunt et al. ..... 250/292
4,761,545 A 8/1988 Marshall et al.

(Continued)

FOREIGN PATENT DOCUMENTS

EP 1 339 088 8/2003

(Continued)

OTHER PUBLICATIONS

Wells, et. al., "Dueling ESI: Instrumentation to Study Ion/Ion Reactions of Electrospray-generated Cations and Anion", Journal of the American Society of Mass Spectrometry, 2002, 13, pp. 614-622.*

(Continued)

*Primary Examiner* — Robert Kim
*Assistant Examiner* — Nicole Ippolito Rausch
(74) *Attorney, Agent, or Firm* — B. Aaron Schulman; Terry L. Wright; Stites & Harbison PLLC

(57) ABSTRACT

A method of introducing ions into an ion trap and an ion storage apparatus are described. Introduction means are used to introduce first ions into an ion trap through an entrance aperture to the ion trap. An operating condition of the introduction means is adjusted to cause second ions, of different polarity to the first ions to be introduced into the ion trap through the same entrance aperture.

25 Claims, 6 Drawing Sheets

U.S. PATENT DOCUMENTS

| | | | | |
|---|---|---|---|---|
| 4,963,736 | A | 10/1990 | Douglas et al. | |
| 5,134,286 | A * | 7/1992 | Kelley | 250/282 |
| 6,326,616 | B1 * | 12/2001 | Andrien et al. | 250/288 |
| 6,380,666 | B1 | 4/2002 | Kawato | |
| 2001/0050335 | A1 * | 12/2001 | Whitehouse et al. | 250/288 |
| 2002/0175278 | A1 * | 11/2002 | Whitehouse | 250/281 |
| 2003/0155502 | A1 | 8/2003 | Grosshans et al. | |
| 2003/0222213 | A1 | 12/2003 | Taniguchi | |
| 2005/0199804 | A1 * | 9/2005 | Hunt et al. | 250/290 |

FOREIGN PATENT DOCUMENTS

| | | |
|---|---|---|
| EP | 1 369 901 | 12/2003 |
| GB | 1362232 | 7/1974 |
| JP | 2000111526 | 4/2000 |

OTHER PUBLICATIONS

Syka et. al., "Peptide and protein sequence analysis by electron transfer dissociation mass spectrometry", PNAS, 2004, 101, 26, pp. 9528-9533.*

Wells et al, ""Dueling" ESI: instrumentation to study ion/ion reactions of electrospray-generated cations and anions", Jun. 2002, pp. 614-622, vol. 13, No. 6, Journal of the American Society for Mass Spectrometry, Elsevier Science, Inc., New York, NY USA.

Syka et al, "Peptide and Protein Sequence Analysis by Electron Transfer Dissociation Mass Spectrometry", Jun. 29, 2004, pp. 9528-9533, vol. 101, No. 26, Proceedings of the National Academy of Sciences of USA, National Academy of Science, Washington D.C., USA.

J. Wu et al, "Positive Ion Transmission Mode Ion/Ion Reactions in a Hybrid Linear Ion Trap", Sep. 1, 2004, pp. 5006-5015, vol. 76, No. 17, Anal. Chem.

Syage et al, "Atmospheric pressure photoionization—II. Dual source ionization", Oct. 1, 2004, pp. 137-149, vol. 1050, No. 2, Journal of Chromatography, Elsevier Science Publishers B.V., Amsterdam, NL.

Paul et al., "Ein neues Massenspektrometer ohne Magnetfeld", 1953, pp. 448-450, Notizen.

Fischer, "Die dreidimensionale Stabilisierung von Ladungstragern in einem Vierpolfeld" 1959, pp. 1-26, Zeitschrift fur Physik.

Ding et al, "Ion motion in the rectangular wave quadrupole field and digital operation mode of a quadrupole ion trap mass spectrometer", 2001, pp. 176-181, vol. 3, No. 8, Rapid Communication in Mass Spectrometry.

Stephenson, Jr. et al, "Anion Effects on Storage and Resonance Ejection of High Mass-to-Change Cations in Quadrupole Ion Trap Mass Spectrometry", 1997, pp. 3760-3766, vol. 69, No. 18, Analytical Chemistry.

Dearth, Mark A., "Nitric Oxide Chemical Ionization Ion Trap Mass Spectrometry for the Determination of Automotive Exhaust Constituents", Dec. 15, 1997, pp. 5121-5129, vol. 69, No. 24, Analytical Chemistry.

Lu et al, "Pulsed Electrospray for Mass Spectrometry", Oct. 1, 2001, pp. 4748-4753, vol. 73, No. 19, Analytical Chemistry.

Syka, John E.P., "Commercialization of the Quadrupole Ion Trap", pp. 170-220, vol. 1, Practical Aspects of Ion Trap Mass Spectrometry.

* cited by examiner

METHOD FOR INTRODUCING IONS INTO AN ION TRAP AND AN ION STORAGE APPARATUS

FIELD OF THE INVENTION

This invention relates to a method of introducing ions into an ion trap and an ion storage apparatus.

BACKGROUND OF THE INVENTION

The use of the Quadrupole Ion Trap (QIT) as a means of trapping and storing charged particles was first described in 1953 by W. Paul and H. Steinwedel, Zeitschrift fur Naturforschung, 8A; 1953, p 448 and U.S. Pat. No. 2,939,952. The technology continued to develop, and the QIT was first used as a Mass Spectrometer in 1959, as described in E. Fischer, Zeitschrift f. Physik 156, 1959 p 1-26. Since then, the development of the QIT for ion storage and mass analysis has progressed steadily. This progress is reviewed in "Quadrupole Ion Trap Mass Spectrometry", Raymond E. March and John F. Todd.

More recently however, attention has been focussed on 2D ion traps, which are also referred to as Linear Ion Traps (LIT) and Digital Ion Traps (DIT) as described in "Ion Motion in the Rectangular Wave Quadrupole Field and Digital Operation Mode of a Quadrupole Ion Trap Mass Spectrometer", L. Ding et al. Vacuum Science and Technology, V.21, No. 3, 2001, p 176-181. These alternative ion traps have greatly advanced the capabilities of ion traps in the field of Mass Spectrometry.

The possibility of using ion traps to store charged particles irrespective of polarity and for the stored particles to then be manipulated has long been recognised. However, until more recently, this aspect of the use of ion traps has been less successful than the utility of the Ion Trap as a Mass Spectrometer (ITMS).

An advantage of an ion trap acting as an ion storage facility came with the discovery and development of the resonant ejection process. Using the resonant ejection process it became possible to retain a specific ion/group of ions (according to their mass/charge ratio) in the ion trap, whilst simultaneously ejecting the other ions from the ion trap. The retained ions are termed the precursor or analyte ions. Once the precursor ions are isolated in the ion trap they are subject to resonant excitation and a collision gas is introduced into the ion trap. This leads to the precursor ions undergoing a fragmentation process. This fragmentation allows component parts of the precursor ions to be identified. From the identification of the masses of the individual fragments and their relative contribution to the mass spectrum, it is possible to elucidate the structure of the precursor ions.

It is also well known that the ion trap can simultaneously retain ions of different polarities (anions and cations). However, the introduction, ejection and detection of both anions and cations stored simultaneously in the ion trap is difficult to achieve in a typical ion trap configuration due to the unipolar nature of the ion optics related to the ion introduction, ejection and detection.

"Anion Effects on Storage and Resonance Ejection of High Mass-to-charge Cations in Quadrupole Ion Trap Mass Spectrometry", J. L. Stephenson, Jr. and S. A. McLuckey Anal. Chem., 69 (1997) p 3760-66 describes studies performed on the interactions between ions of different polarities within an ion trap.

A number of different experimental approaches have been devised to address the problem of introducing and storing different ions in the ion trap.

One approach used is to provide an additional entrance aperture in the ring electrode of the ion trap, to allow the introduction of the alternative ions into the ion trap. However, this approach has limited viability due to the requirement of using two sets of introduction electrodes, one for analyte ions and the other for reagent ions. Also, the additional entrance aperture gives rise to undesirable field distortion within the ion trap. The basic instrument set up is described by Dearth et al. in their paper entitled "Nitric Oxide Chemical Ionization/Ion Trap Mass Spectrometry for the Determination of Hydrocarbons in Engine Exhaust" Anal. Chem 69 1997 p 5121-5129. This is a very expensive option and there are currently no commercial available instruments like this.

An alternative geometry is described in "Dueling ESI: Instrumentation to study ion/ion reactions of electrospray-generated cations and anions". Wells J. M. et al. J. Am. Sol, Mass Spectrometry 2002 Jun. 13 (6), p 614-622. This apparatus has two separate ion sources, each with an associated set of transmission optics. The two sets of transmission optics have opposite polarities and are arranged to direct the generated anions and cations into the ion trap through a single entrance aperture.

Electron Capture Dissociation (ECD) is a recently developed technique used in Fourier Transform Ion Cyclotron Resonance (FTICR) that has provided improved and highly desired fragmentation capabilities. In this technique, electrons with appropriate thermal energy are kept in close proximity to an ionised molecule of interest e.g. a protein or peptide. One or more electrons are captured by the molecule of interest which subsequently undergoes fragmentation. ECD seems to be very attractive for fragmentation in ion traps and attempts have been made to adapt the technique but, the optimum conditions for ECD can only be achieved using a couple of specific ion trap designs.

A related technique, known as Electron Transfer Dissociation (ETD) can be used in an ion trap. This technique uses an ion (typically an anion) with a low electron affinity, which acts to transfer an electron in a similar manner to ECD. This technique has been used in the fragmentation of proteins/peptides and appears to be effective in achieving a more complete or preferred cleavage of a protein/peptide backbone. This improved fragmentation is useful in determining the structure and/or other properties of the protein/peptide.

ETD is an example of an ion-ion reaction.

Clearly, to efficiently use this ETD technique it is necessary to introduce ETD anions into the ion trap, to allow ETD anions to interact with the ions to be studied. Recently, Syka et al. in "Peptide and Protein Sequence Analysis by Electron Transfer Dissociation Mass Spectrometry." John E. P. Syka et al. PNAS, Jun. 29, 2004. Vol. 101 No. 26, pp 9528-9533 have described an apparatus in which analyte ions in the form of protein/peptide cations are introduced in the normal fashion through the entrance aperture of the LIT, whilst the reagent ions in the form of anthracene anions (acting as the ETD anions) are introduced into the LIT at the opposite end of the LIT to the entrance aperture.

As can be seen from the above discussion, the ETD technique has obvious advantages. However, this technique is still not generally applicable to the most common configurations of ion traps without significant mechanical modifications to the ion trap.

To make this ETD technique a truly general purpose technique with widespread applications it is preferable to use a standard ion trap mass spectrometer which requires minimal mechanical modifications.

SUMMARY OF THE INVENTION

According to the invention there is provided a method of introducing ions into an ion trap comprising the steps of:

using introduction means to introduce first ions into said ion trap through an entrance aperture to the ion trap and adjusting an operating condition of the same said introduction means selectively to cause second ions, of different polarity to the first ions, to be introduced into the ion trap through the same said entrance aperture.

In a preferred embodiment, the first and second ions follow a common path through the introduction means, typically a set of ion optics, and enter the ion trap through the same entrance aperture.

The first and second ions may have different mass-to-charge ratios and/or charges of different magnitude.

In a preferred embodiment of the invention the first and second ions are suitable for ion-ion reactions, and one of the first and second ions is a reagent ion, for charge reduction and possibly inducing Electron Transfer Dissociation of another of said first and second ions.

In an embodiment of the invention the first and second ions may be generated by the same or different ion sources. The first and second ions may be generated by one or more of APCI (Atmospheric Pressure Chemical Ionization), PI (Photo Ionization), CI (Chemical Ionization), ESI (Electrospray Ionization) or MALDI (Matrix Assisted Laser Desorption/Ionization).

In an embodiment of the invention the introduction means includes an electrostatic transmission lens and said step of adjusting said operating condition of said introduction means includes inverting a d.c. potential gradient along a transmission axis of the lens. Preferably, the step of inverting the d.c. potential gradient includes changing the bias voltage of the transmission lens.

The said introduction means may include a gate lens and said step of adjusting said operating condition includes changing the bias voltage of the gate lens.

In an embodiment of the invention the method may also include the step of disabling the introduction means prior to said adjusting step whereby to terminate introduction of said first ions.

The first and/or second ions may be introduced into the ion trap in a continuous manner; alternatively they may be introduced into the ion trap in a pulsed manner.

According to the invention there is also provided an ion storage apparatus comprising: an ion trap having an entrance aperture; introduction means for introducing first and second ions into the ion trap, said first ions being different to said second ions, adjustment means for adjusting an operating condition of said introduction means whereby said first and second ions are selectively introduced into the ion trap via the same said entrance aperture of the ion trap.

According to the invention there is further provided a method of introducing ions into an ion trap comprising the steps of: using introduction means to introduce first ions into said ion trap through an entrance aperture of the ion trap and adjusting an operating condition of the introduction means, selectively to cause second ions, having opposite polarity to said first ions, to be introduced into the ion trap through the said entrance aperture, whereby said second ions provide charge compensation to mitigate the effects of coulomb repulsion and reduce the size of the ion cloud.

BRIEF DESCRIPTION OF THE DRAWINGS

A method of introducing ions into an ion trap, and the associated apparatus is now described, by way of example only, with reference to the accompanying figures in which.

DETAILED DESCRIPTION

Figure 1:
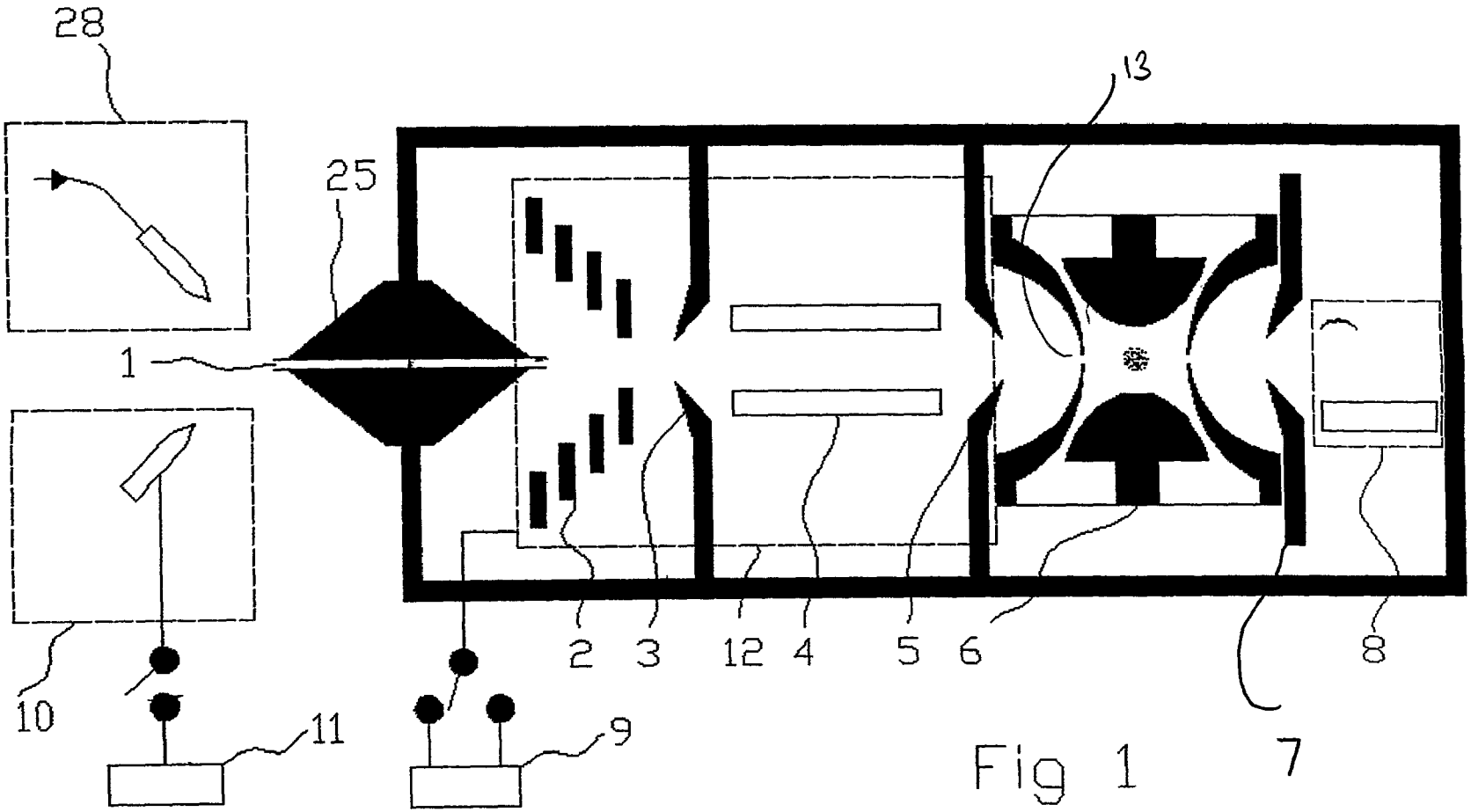
FIG. 1 is a cross-section through an Ion Trap Mass Spectrometer according to the invention.

As illustrated by FIG. 1, the Ion Trap Mass Spectrometer (MS) typically comprises six parts, namely; an analyte ion source 28, a reagent ion source 10, having a controllable power supply 11, an atmospheric pressure/low pressure interface 25, transmission optics 12 having a controllable voltage source 9, an ion trap 6 and a detector 8.

Electrospray Ionisation (ESI) is one method commonly used to generate singly and multiply charged ions from an organic sample solution. This type of ion source is often used as a link between a Liquid Chromatograph (LC) and a Mass Spectrometer (MS). The atmospheric pressure/low pressure interface 25 is used to pull wet charged particles from the ESI into the vacuum chamber of the MS and dry them, through the so-called desolvation process. The atmospheric pressure/low pressure interface may be in the form of a heated capillary/ion inlet, as illustrated by 1 in FIG. 1, or alternatively a number of cone shaped apertures, between which a heated gas flows to facilitate the desolvation process.

Exiting from the atmospheric/low-pressure interface 25, the dried ions enter the first ion transmission lens 2; a Quadrupole Array (Q-Array) which is kept at a rough vacuum of approximately $10^{-0}$~$10^{-1}$ mbar. To facilitate transfer of the ions from the low vacuum region to the high vacuum region where the ion trap is operating, high frequency AC Q-Array transmission lens 2 and quadrupole lens 4 are employed, in conjunction with electrostatic skimmer lens 3 and electrostatic gate lens 5. These lenses are situated in a series of differentially pumped vacuum chambers, with the atmospheric pressure region separated from the low-pressure region by the atmospheric/low pressure interface 25. The aforementioned low-pressure region is separated into stages of progressively higher vacuum by the electrostatic skimmer lens 3 and the electrostatic gate lens 5 from the high vacuum of the ion trap 6.

The use of such high frequency AC lenses in the low-pressure region relates to a high frequency ion transfer and focusing technique that is well known, and is described in GB1362232 (Masuda, 1974), U.S. Pat. No. 4,963,736 (Douglas 1990) and US2003/222213 (Taniguchi, 2003). This technique assists focusing of ions along the ion transmission axis and guidance of the ions through the small apertures between the differentially pumped vacuum chambers. Whilst the varying AC potential inside the ion transmission lens 2 and quadrupole lens 4 focuses the ions towards the transmission axis, a DC potential distribution along the transmission axis assists the ions travelling towards the analyser, and, additionally can be used to control the axial velocity of the ions. The application of appropriate DC bias voltages to each lens of the transmission optics 12 can be used to create a suitable DC potential distribution along the transmission axis.

An ion trap MS usually works in particular modes for the analysis of positive/negative ions. For the detection of positive ions (cations), the DC biases at the ion source 28, the ion transmission optics 12 and the detector 8 are set to enable cations to be ejected from the Mass Spectrometer. For negative ion (anion) detection the DC biases are set to enable anions to be ejected from the Mass Spectrometer.

In order to carry out an MS/MS experiment using Electron Transfer Dissociation (ETD), analyte ions and reagent ions having opposite polarities are sequentially transmitted to the analyser, and product ions with a single polarity are ejected from the ion trap 6 into the detector 8. The bias applied to the extraction lens 7 and the detector 8 should be the same as that applied in a typical MS/MS experiment, while the bias applied to the transmission optics 12 should be adjusted, according to the polarity and mass-to-charge ratio of the ions passing through the transmission optics.

Figure 2:
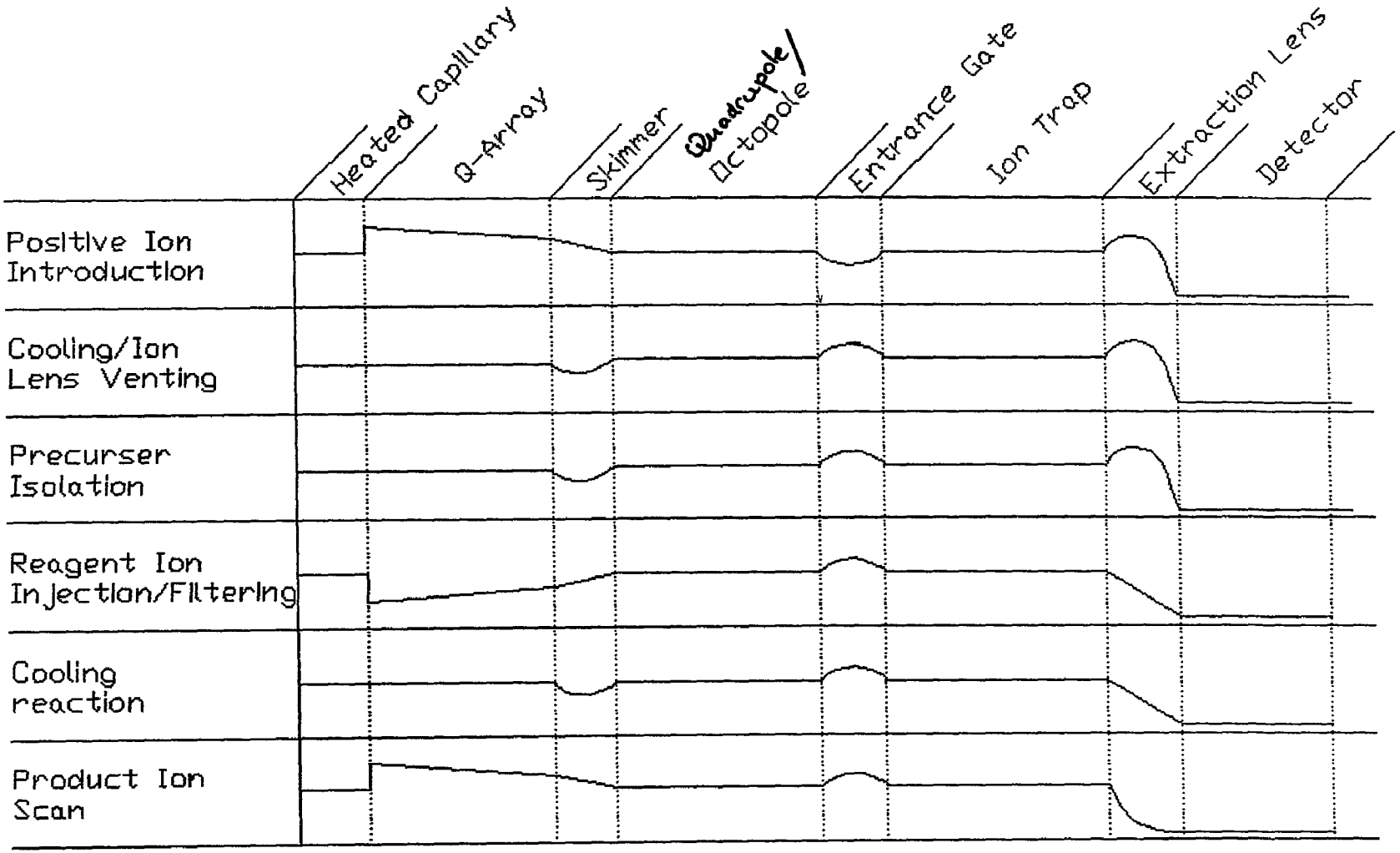
FIG. 2 is an illustration of the change of DC bias during a complete cycle of an MS/MS experiment.

FIG. 2 gives a further illustration of the change of DC bias during a complete cycle of an MS/MS experiment.

Referring back FIG. 1, a reactive MS/MS cycle starts with the introduction of analyte ions (cations) generated by the electrospray ion source 28 into the Mass Spectrometer. The Q-Array transmission lens 2 and a Quadrupole lens 4 together with electrostatic skimmer lens 3 and gate lens 5 enable the analyte cations generated by the ion source 28 to be transferred from the heated capillary 1 to the entrance aperture 13 in one end cap of the ion trap 6. The analyte ions are typically multiply protonated peptides carrying positive charges (e.g. Substance P), although other analyte ions may be used. A decrease in the DC potential drop along the transmission axis is used to move the analyte ions through the low pressure region of the lens system. The energy provided by the decrease in the axial DC potential will be partially consumed through collisions between the analyte ions and neutral gas molecules near the electrostatic skimmer lens 3 between the Q-Array transmission lens 2 and the Quadrupole lens 4. At this time, the gate lens 5 is set at negative voltage relative to the axial potential of the quadrupole lens 4 using controllable voltage source 9. This allows the positive analyte ions to pass through the gate lens 5 into the ion trap 6 via the entrance aperture 13. The analyte ions enter the ion trap 6 and will be accumulated within the ion trap 6 for a set period of time. A set cooling period may also be applied to the analyte ions in the ion trap 6 before the procedure for analyte ion isolation is carried out.

Dipole excitation of the analyte ions in the ion trap 6 is generated by use of digitally created waveforms. Techniques such as SWIFT (Stored Wave Inverse Fourier Transform) or FNF (Filtered Noise Field) as described in Marshall et al, U.S. Pat. No. 4,761,545 (1988) and Kelley, U.S. Pat. No. 5,134,286 (1992) respectively can be used for the dipole excitation. A pre-selected analyte ion with a specific mass to charge ratio can be isolated in the ion trap 6 whilst all other analyte ions are ejected from the ion trap. During this period, the ion transmission optics 12 should be gated off so that no further analyte ions can enter the ion trap 6. Additionally, the injection of the analyte ions into the Mass Spectrometer from the ion source 28 should be stopped, to allow for the depletion of the analyte ions in the transmission lenses 12.

In order to cut off the injection of analyte ions into the Mass Spectrometer the high voltage on the ion source 28 may be dropped rapidly to stop the spray, as described in P Yang etc, Analytical Chemistry. 2001 73, 4748-4753; alternatively, additional pulsed deflectors positioned in front of the inlet of the capillary 1 are activated (not shown). In order to deplete the analyte ions from the transmission optics 12, the high frequency drive for the quadrupole lens 4 may be switched off, or alternatively a high DC voltage between the quadrupole rods of quadrupole lens 4 may be applied so all of the analyte ions become unstable and collide with the quadrupole electrodes.

Figure 3:
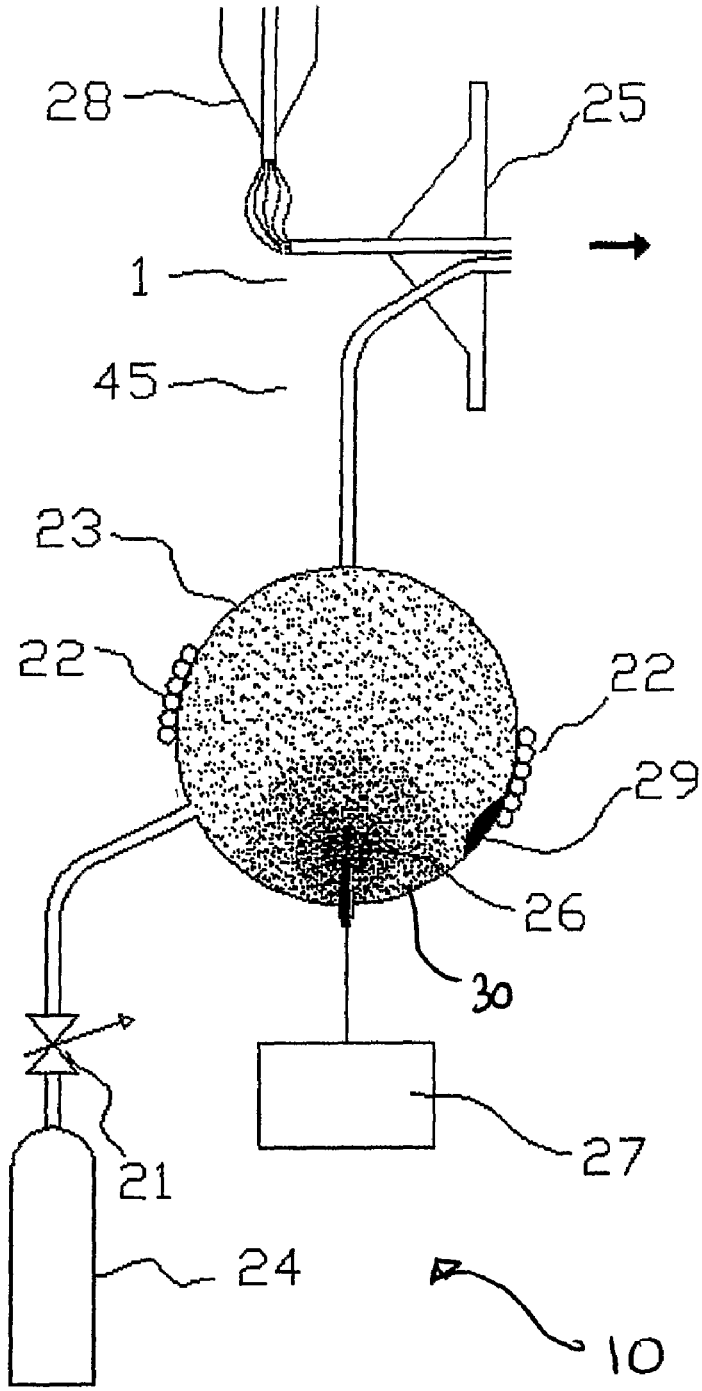
FIG. 3 shows a conventional Atmospheric Pressure Chemical Ionisation source.

Once the analyte ion isolation cycle has been completed, the injection of reagent anions into the Mass Spectrometer begins. In this particular embodiment, the reagent anions are generated in the reagent ion source 10 in the form of a chemical ionization cell 23 as shown in FIG. 3. The reagent anions are transported into capillary 45 by a carrier gas, provided by gas source 24 through valve 21. The injection of reagent gas into the chemical ionization cell 23 can be activated by the pulsed operation of the valve 21. For the particular application of ETD, the reagent anion is typically a strong electron donor and can easily lose its electric charge during collisions with other gaseous species. Typically, the reagent anion is an Anthracene anion, although, other ions may be used. In this case, the carrier gas provided by the gas source 24 is typically either a noble gas or high purity nitrogen gas, which is a poor electron acceptor.

When the reagent anions exit the capillary 45 and enter the Mass Spectrometer through the atmospheric/low pressure interface 25, the DC potential along the transmission axis of the Q-array transmission lens 2 is changed to an increasing gradient so that the reagent anions may be transferred through the transmission lens 2 and the electrostatic skimmer lens 3. The voltage and/or frequency of the Q-array transmission lens 2 may also have to be changed to maximize the efficiency of transmitting the reagent anions, since those have a relatively lower mass/charge ratio when compared to a typical peptide ion.

The voltage at the gate lens 5 should also be set a positive potential relative to the axial potential of the quadrupole lens 4 by adjusting the controllable voltage source 9. In this manner, the gate lens 5 opens to allow negative reagent anions to pass through the gate lens 5 into the ion trap 6 again via the entrance aperture 13. The trapping mass range of the ion trap 6 should also be set to allow trapping of both the isolated analyte ions and the injecting reagent anions. The ion trap is bipolar in nature and can trap positive and negative ions with equal facility, ions that are contained in the ion trap remain trapped, until the operating conditions are adjusted to eject ions from the trap.

It may be that some impurity anions become mixed with the desired reagent anions. In this case, the quadrupole lens 4 can be operated as a band pass mass filter to remove the unwanted impurity anions. If such a resolving mode of the quadrupole lens 4 is not available, for example, if an octopole set of lenses is used instead of a quadrupole, then the ion trap 6, itself can also be used to prevent the impurity ions being accumulated within the ion trap 6. A broadband excitation waveform may be designed to eject the unwanted impurity anions from the ion trap 6 while leaving two notches of frequency band for the retention of both the analyte ions and reagent ions in the ion trap 6. This method relates to creating a plurality of notches for simultaneously reserving more than one mass to charge ratio and has been disclosed in EP 1369901, U. Yoshikatsu.

The duration of this process depends on the ion flux provided by the reagent anion source. When the abundance of the reagent anions in the ion trap 6 achieves the desired level, injection of reagent anions from the ion source 10 into the Mass Spectrometer is halted and the quadrupole lens 4 is biased to prevent any further reagent anions from being transferred into the Mass Spectrometer.

In the subsequent period of time the reagent anions start to cool down to the centre of the ion trap 6, and a reaction between the reagent anions and analyte cations, for example, an ETD reaction, can now take place. The product ions are generated by the reaction between the analyte cations and reagent ions, a mass scan is triggered and a mass spectrum of the product ions will be obtained.

The reagent anion source in this embodiment is a conventional Atmospheric Pressure Chemical Ionization (APCI) source as shown in FIG. 3. Needle 26 is charged to a potential of several kV by power supply 27, which provides a corona 30 within the ionisation cell 23, where the reagent is evaporated by an electric heater 22. The chemical ionization can also occur in a reduced-pressure ionisation cell.

Figure 4A:
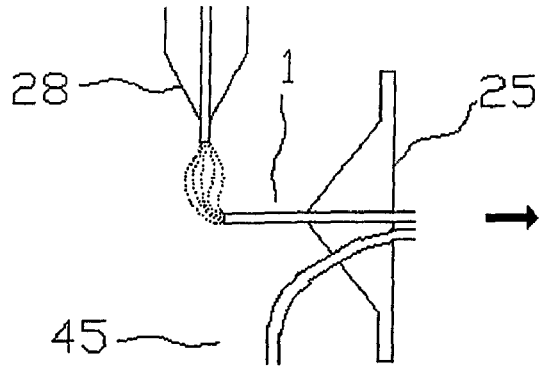
FIG. 4*a* shows the transfer of anions from the ion source to the interface region of the Mass Spectrometer by the use of parallel capillaries.
Figure 4B:
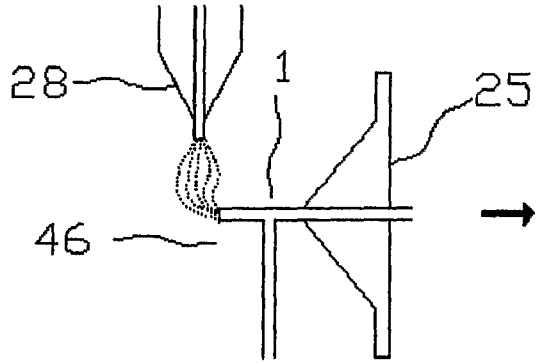
FIG. 4*b* shows the transfer of anions from the ion source to the interface region of the Mass Spectrometer by the use of T-piece capillaries.
Figure 4C:
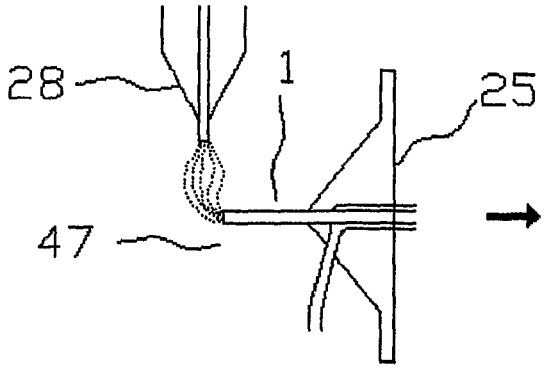
FIG. 4*c* shows the transfer of anions from the ion source to the interface region of the Mass Spectrometer by the use of concentric capillaries.

The method of transfer of the reagent anions from the reagent source 10 into the $10^{-1}$ mbar region of the Mass Spectrometer can be carried out by parallel capillaries 45, as shown in FIG. 4*a*; via a T-piece capillary 46 as shown in FIG. 4*b* or by concentric capillaries 47 as shown in FIG. 4*c*. Each of these capillaries pass through atmospheric/low pressure interface 25 into the main body of the Mass Spectrometer. Each method of transfer has its own merits and applications as will be clear to those skilled in the art.

Figure 5A:
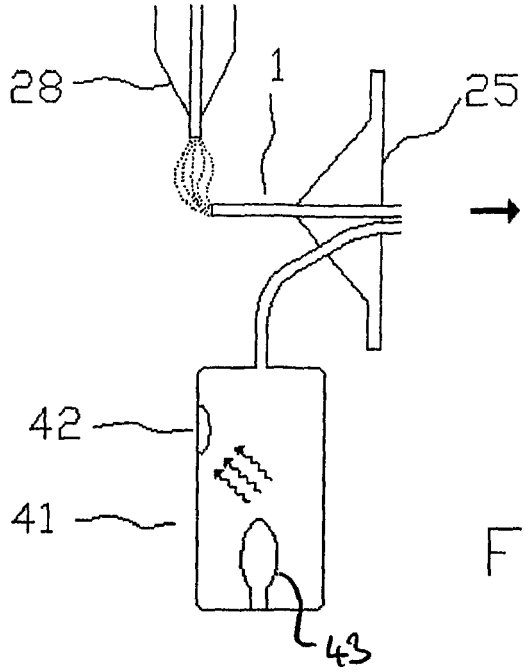
FIG. 5*a* shows the generation of reagent ions using the photo-ionisation method.
Figure 5B:
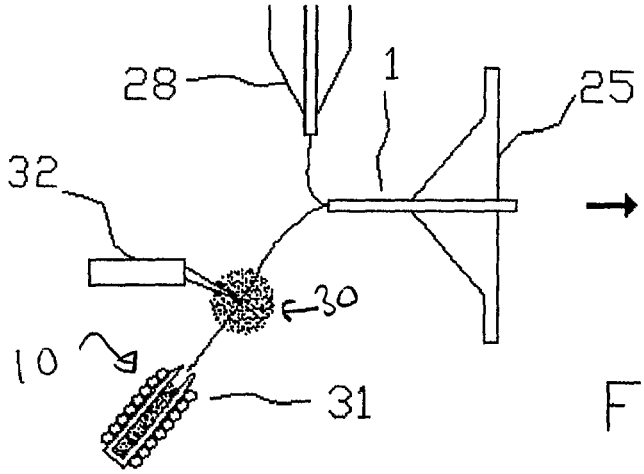
FIG. 5*b* shows the generation of reagent ions by corona ionisation at atmospheric pressure.

Certain reagent molecules can be directly ionised by a corona at atmospheric pressure. As shown in FIG. 5*b*, such a reagent source 10 comprises only a heated reagent container 31, having an opening pointed at the capillary 1, and high voltage needle electrode 32. When a negative high voltage is applied to the needle electrode 32, a discharge corona 30 is generated around the needle tip and reagent vapour passing through the corona 30 is ionised. Pulsing the needle electrode 32 provides an alternative means of activating and deactivating the reagent ion source 10.

Figure 5C:
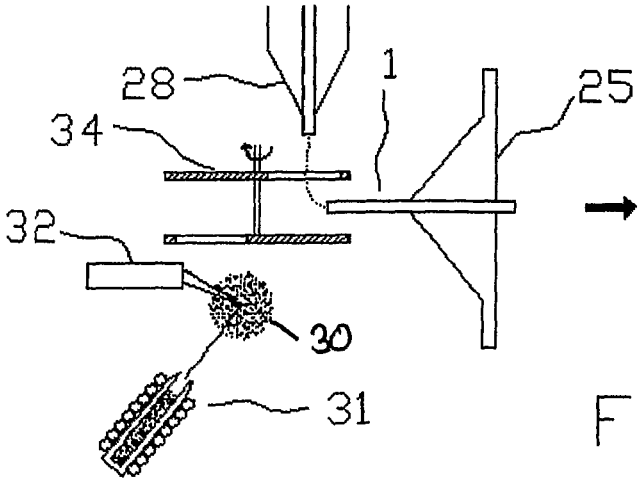
FIG. 5*c* shows a mechanical shutter positioned between the ion sources and the interface region of the Mass Spectrometer.

During the deactivation of each individual reagent source 10, there is the possibility that vapour or ions from the deactivated reagent source 10 may contaminate the active source and vice versa, thus causing cross talk between the two ion sources and resulting in an increase in chemical noise. To avoid this, a synchronised mechanical shutter 34 (as shown in FIG. 5*c*) may be employed. This will allow only one of the analyte ions/reagent anions into the Mass Spectrometer at a time.

It is also possible to generate the reagent anion by using a photo-ionisation method. In this case, as shown in the FIG. 5*a*, a UV lamp 43 is employed to irradiate the volume 41 that contains the vapour of the reagent substance 42.

Figure 6:
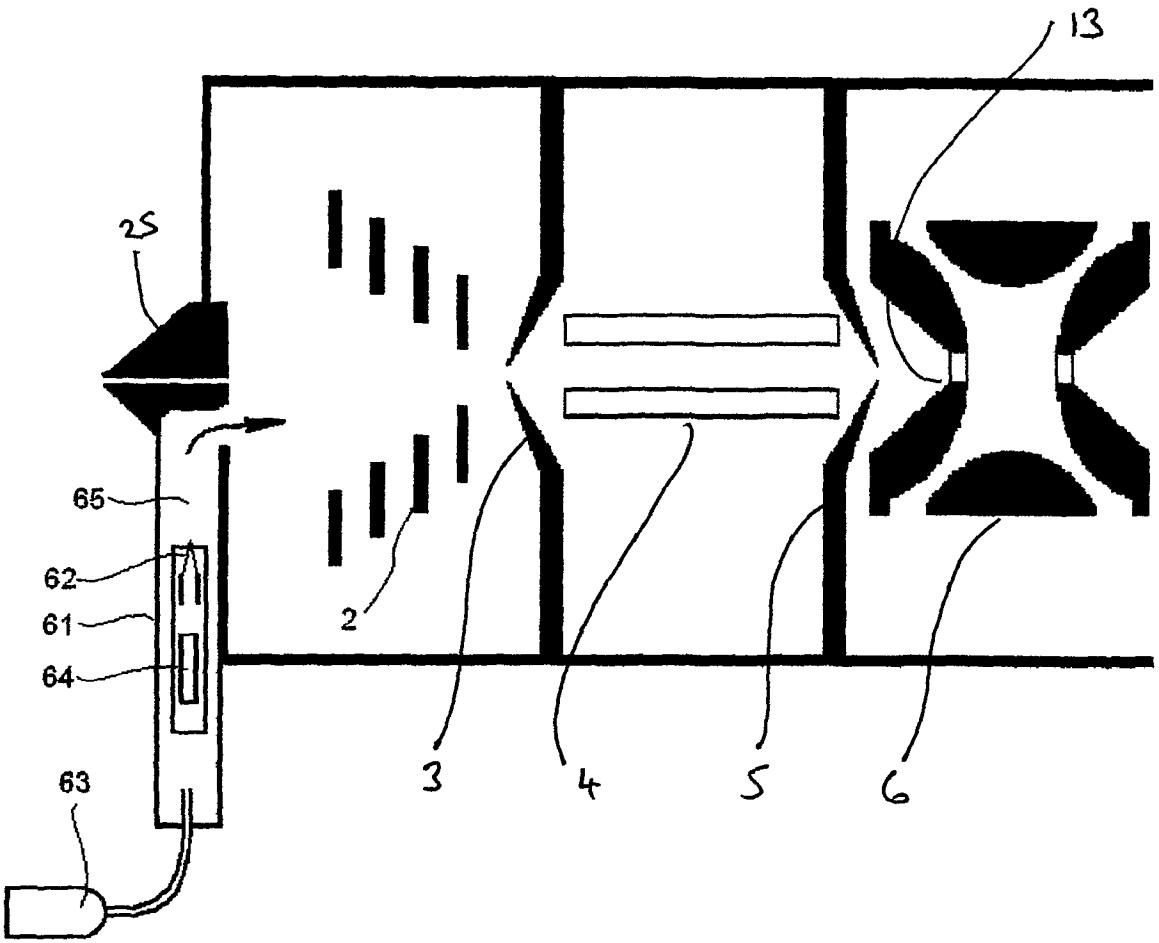
FIG. 6 shows the generation of reagent ions by electron attachment in a gas flow assisted glow discharge tube.

The reagent anion can also be generated in a flow tube directly linking to the vacuum chamber of the first ion introduction optics. As illustrated in FIG. 6, the ion source in this embodiment is a hot filament glow discharge ion source 60 situated in the flow tube 61, connected to the inlet of high frequency Q-array transmission ions 2 in the first pumping stage. A filament 62 emits electrons to the gas flow supplied by the gas source 63, in order to sustain a low voltage discharge. Pure argon or a mixture of argon with CO2 may be used for the gas flow. A substance 64 such as anthracene, for anion generation is also stored in the flow tube 61 and the heat radiated by the filament 62 may be sufficient to cause evaporation of the anthracene, so the anthrathene molecules are mixed into the gas flow. An electron travelling along with a positive ion in the discharging plasma 65 may be effectively cooled down through collision and Coulomb dragging in the plasma. The resulting low kinetic energy of the electron makes it possible for the electron to attach to a vaporised anthracene molecule thus resulting in the reagent anion. The generated anthracene reagent anion follows the gas flow and reaches the entrance of the first ion transmission lens, the Q-array 2 and is introduced to the ion trap 6 in the same way as analyte ions described previously.

It is also possible to use the electrospray technique to generate negative reagent anions. Substances commonly used in ETD, e.g. Anthracene, may not easily dissolve in solution at a concentration which is suitable to produce sufficient reagent anions for an ETD experiment; the alternate injection of ions of opposite polarity by ESI provides a useful capability for applications related to other ion-ion reactions and so is still within the scope of the invention.

In a separate but related method, non-reactive ions with a charge of an opposite polarity to the analyte ions are introduced into the ion trap 6. The purpose of introducing these non-reactive ions is to provide charge compensation within the ion cloud, with the intention to mitigate the effects of coulomb repulsion.

In typical operation, the trapped ions are cooled by collisions with a buffer gas (such as helium) towards the centre of the ion trap 6. As the trapped ions get closer together, their individual charges repel other trapped ions, keeping them apart by coulomb repulsion. This is the so-called space-charge effect. Eventually, the trapped ions will cool, through collisions with buffer gas, towards the centre of the ion trap 6 and approach the limits imposed on the size of the ion cloud by the space-charge effect. Coulomb repulsion is a prime factor in determining the size of the ion cloud in the ion trap and the size of the ion cloud can give rise to deleterious effects in respect of mass linearity and resolution in a mass scan or ion isolation. Reducing the size of the ion cloud by mitigating the effects of coulomb repulsion by means of charge compensation reduces the resulting energy spread of the ejected ions and produces either a) a corresponding improvement in mass resolution for the same ion density or b) an improvement in signal intensity for the same mass resolution depending on the number of compensating charges introduced to the trap.

In a preferred embodiment the ion trap 6 is coupled to a Time of Flight (ToF) analyser (not shown) such as described by Kawatoh in U.S. Pat. No. 6,380,666 (April 2002). A known limitation in achieving the highest mass resolution combined with high signal intensity in this type of configuration is the spatial distribution and velocity of the ions at the time of fast ejection from the ion trap 6 into the ToF analyser. In the ToF mass analyser a limited range of energy spread at the source of ions, in this case the ion trap 6, can be compensated by use of an ion mirror but, the energy spread introduced by the spatial position and velocity of the ions in an ion trap 6 when the fast ejection voltage is applied is not fully correctable by the ion mirror. Therefore the capability to reduce the energy spread caused by the spatial distribution in the ion trap 6 is highly desirable. Analyte ions are stored in the ion trap 6 and mass spectrometric operations (ion isolation, fragmentation or dissociation, for example) may be carried out on them whilst they are stored in the ion trap 6. After these operations are completed, cooling of the trapped ions with the buffer gas takes place, and the compensating charge ions are introduced into the ion trap 6 by the means previously described for the reagent anions. Both the analyte ions and the charge compensating ions are allowed to further cool to the centre of the ion trap 6. The RF is then rapidly switched off, and fast ejection voltages are applied to the end caps of the ion trap 6 in order to eject the analyte ions from the ion trap 6 into the ToF mass analyser.

In a further embodiment the ion trap 6 is used in the well-known analytical mode as a mass analyser. During a mass scan, resonantly excited ions pass through the unexcited ions that remain in the ion cloud multiple times prior to their eventual ejection from the ion trap 6. It is well known that high densities of ions of the same polarity can lead to spectral artefacts and non-linearities in a mass spectrum. As will be obvious to those skilled in the art, the capability to reduce space-charge effects at the centre of the ion trap caused by large accumulations of the same polarity charges is effective to remove artefacts and non-linearities in the mass spectrum whilst simultaneously allowing high signal intensities to be measured.

As will also be apparent to those skilled in the art, the method of charge compensation as described will have many other useful applications in Ion Trap Mass Spectrometry (ITMS).

The invention claimed is:

1. A method of introducing ions into an ion trap comprising the steps of: using introduction means to introduce first ions into said ion trap through an entrance aperture to the ion trap and adjusting an operating condition of the same said introduction means selectively to cause second ions, of different polarity to the first ions, to be introduced into the ion trap through the same said entrance aperture, wherein said introduction means includes an AC multipole lens for focusing ions toward a transmission axis of the introduction means, and wherein said step of adjusting said operating condition includes inverting a DC potential gradient along said transmission axis of the introduction means so that said first and second ions travel in the same direction along a path through the AC multipole lens.

2. A method according to claim 1 wherein said first and second ions are suitable for ion-ion reactions.

3. A method according to claim 2 wherein one of said first and second ions are reagent ions for causing charge reduction of another of said first and second ions.

4. A method according to claim 3 wherein said charge reduction causes Electron Transfer Dissociation of said another of said first and second ions.

5. A method according to claim 3 wherein said reagent ions are anions generated by electron attachment in a gas flow assisted glow discharge tube.

6. A method according to claim 5 wherein said gas flow assisted glow discharge tube includes a hot filament to provide electron emission.

7. A method according to claim 1 wherein said first ions and said second ions are generated by the same ion source.

8. A method according to claim 1 wherein said first ions and said second ions are generated by different ion sources.

9. A method according to claim 1 wherein said first or second ions are generated by one or more of APCI, CI, PI, ESI, MALDI.

10. A method according to claim 1 wherein said first ions and said second ions have different mass-to-charge ratios.

11. A method as claimed in claim 1 wherein said introduction means includes an electrostatic transmission lens and said step of adjusting said operating condition of said introduction means includes inverting a dc potential gradient along a transmission axis of the lens.

12. A method as claimed in claim 11 wherein said step of inverting a dc potential gradient includes changing the bias voltage of the transmission lens.

13. A method as claimed in claim 11 wherein said introduction means includes a gate lens and said step of adjusting said operating condition includes changing the bias voltage of the gate lens.

14. A method as claimed in claim 11 including the step of disabling the introduction means prior to said adjusting step whereby to terminate introduction of said first ions.

15. A method according to claim 1 wherein said first ions or said second ions are introduced into said ion trap in a continuous manner.

16. A method according to claim 1 wherein said first ions or said second ions are introduced into said ion trap in a pulsed manner.

17. A method according to claim 1 wherein said first and second ions are generated by one or more of APCI, CI, PI, ESI, MALDI.

18. A method according to claim 1 wherein said first ions and said second ions are introduced into said ion trap in a continuous manner.

19. A method according to claim 1 wherein said first ions and said second ions are introduced into said ion trap in a pulsed manner.

20. An ion storage apparatus comprising: an ion trap having an entrance aperture; introduction means for introducing first and second ions into said ion trap, said first ions being of different polarity to said second ions, adjustment means for adjusting an operating condition of said introduction means whereby said first and second ions are selectively introduced into the ion trap via the same said entrance aperture to the ion trap, wherein said introduction means includes an AC multipole lens for focusing ions toward a transmission axis of the introduction means, and wherein said adjustment means is arranged to invert a DC potential gradient along said transmission axis of the introduction means so that said first and second ions travel in the same direction along a path through the AC multipole lens.

21. An ion storage apparatus according to claim 20 wherein said introduction means includes an electrostatic transmission lens and said adjustment means is arranged to invert a dc potential gradient along a transmission axis of said lens.

22. An ion storage apparatus according to claim 21 wherein said adjustment means is arranged to invert said dc potential gradient by changing the bias voltage of said transmission lens.

23. An ion storage apparatus as claimed in claim 21 wherein said adjustment means is arranged to leave the magnitude of said dc potential gradient unchanged.

24. An ion storage apparatus as claimed in claim 21 wherein said introduction means includes a gate lens and said adjusting means is arranged to change the bias voltage of said gate lens.

25. A method of introducing ions into an ion trap comprising the steps of: using introduction means to introduce first ions into said ion trap through an entrance aperture to the ion trap and adjusting an operating condition of the introduction means, selectively to cause second ions, having opposite polarity to said first ions, to be introduced into the ion trap through the same said entrance aperture, whereby said second ions provide charge compensation to mitigate the effects of coulomb repulsion and reduce the size of the ion cloud created by said first ions within the ion trap, wherein said introduction means includes an AC multipole lens for focusing ions toward a transmission axis of the introduction means, and wherein said step of adjusting said operating condition includes inverting a DC potential gradient along said transmission axis of the introduction means so that said first and second ions travel in the same direction along a path through the AC multipole lens.

* * * * *